US006635826B2

(12) United States Patent
Yamamoto et al.

(10) Patent No.: US 6,635,826 B2
(45) Date of Patent: Oct. 21, 2003

(54) FLAT CABLE

(75) Inventors: Tetsuhiro Yamamoto, Hitachi (JP); Masaaki Aoyagi, Hitachi (JP)

(73) Assignee: Hitachi Cable, Ltd., Tokyo (JP)

( * ) Notice: Subject to any disclaimer, the term of this patent is extended or adjusted under 35 U.S.C. 154(b) by 0 days.

(21) Appl. No.: 09/947,763

(22) Filed: Sep. 7, 2001

(65) Prior Publication Data

US 2002/0144837 A1 Oct. 10, 2002

(30) Foreign Application Priority Data

Apr. 6, 2001 (JP) ..... 2001-108711

(51) Int. Cl.[7] ..... H01B 7/00

(52) U.S. Cl. ..... 174/117 F; 174/120 R; 174/27

(58) Field of Search ..... 174/110 R, 113 R, 174/117 F, 117 FF, 120 R, 120 C, 120 AR, 120 SR, 27

(56) References Cited

U.S. PATENT DOCUMENTS 4,404,424 A * 9/1983 King et al. ..... 174/117 F
4,564,723 A * 1/1986 Lang ..... 156/56
4,625,074 A * 11/1986 Cox ..... 174/117 F
4,767,891 A * 8/1988 Biegon et al. ..... 174/112
4,837,405 A * 6/1989 Bonjour et al. ..... 174/112
4,924,037 A * 5/1990 Ainsworth et al. ..... 156/55
4,992,625 A * 2/1991 Izui et al. ..... 174/117 F
5,142,105 A * 8/1992 Kihlken et al. ..... 174/112
5,900,588 A * 5/1999 Springer et al. ..... 174/117 F
6,215,071 B1 * 4/2001 Kasahara et al. ..... 174/117 F
6,392,155 B1 * 5/2002 Shimizu et al. ..... 174/117 F

FOREIGN PATENT DOCUMENTS

JP 3-30210 A * 2/1991 ..... H01B/13/02
JP 2000-299017 A * 10/2000 ..... H01B/07/08
JP 2000-184953 A * 7/2001 ..... H01B/07/08

* cited by examiner

*Primary Examiner*—William H. Mayo, III
(74) *Attorney, Agent, or Firm*—Foley & Lardner

(57) ABSTRACT

A flat cable having parallel portions provided alternately with twisted pair portions in the longitudinal direction of the flat cable, wherein the parallel portions include a plurality of insulated core wires aligned parallel to each other and fused to each other. The twisted pair portions include twisted pairs each having two separately insulated core wires twisted together,wherein a plurality of the twisted pair portions in their surface, backside, and left and right side faces are surrounded and laminated by at least one pressure-sensitive adhesive tape, thermally fusible tape, pressure-sensitive adhesive shield tape, or thermally fusible shield tape.

4 Claims, 5 Drawing Sheets

FLAT CABLE

BACKGROUND OF THE INVENTION

1. Field of the Invention

The invention relates to a flat cable, and more particularly to a twist flat cable comprising parallel portions respectively provided alternately with twisted pair portions in the longitudinal direction of the cable, the parallel portion comprising insulated core wires fused to each other, the twisted pair portion comprising twisted pairs each composed of two separately insulated core wires twisted together and being laminated by at least one tape.

2. Prior Art

Flat cables have advantages including the elimination of the need to provide bundle wires and easy wiring due to high flexibility. By virtue of these advantageous, flat cables are utilized in internal wiring of electronic equipment such as personal computers and communication equipment. FIGS. 8 to 14 show conventional flat cables of such a type that parallel portions each comprising insulated core wires fused to each other are respectively provided alternately with twisted pair portions each comprising twisted pairs each composed of two separately insulated core wires twisted together and being laminated in such a manner that the twisted pair portion is sandwiched between two tapes.

FIG. 8 is a plan view of a conventional flat cable, FIG. 9 an enlarged cross-sectional view taken on line IX—IX of FIG. 8, and FIG. 10 an enlarged cross-sectional view taken on line X—X of FIG. 8. A conventional flat cable 20 comprises parallel portions 1 respectively provided alternately with twisted pair portions 2 in the longitudinal direction of the cable. The parallel portion 1 comprises a plurality of insulated core wires aligned parallel to each other and fused to each other. The twisted pair portion 2 comprises twisted pairs each composed of two separately insulated core wires 6 twisted together. The twisted pair portion 2 is laminated in such a manner that two pressure-sensitive adhesive tapes or thermally fusible tapes 3 are disposed respectively on the upper and lower portions of the twisted pair portion 2 so as to sandwich the twisted pair portion 2 therebetween. The insulated core wire 6 comprises a conductor 4 and an insulation 5 covering the circumference of the conductor 4.

FIGS. 11 to 14 show another example of the conventional flat cable. FIG. 11 is a plan view (a surface view), FIG. 12*a* bottom view (a backside view), FIG. 13 an enlarged cross-sectional view taken on line XIII—XIII of FIG. 11, and FIG. 14 an enlarged cross-sectional view taken on line XIV—XIV of FIG. 11.

This conventional flat cable 20*a* comprises parallel portions 1 respectively provided alternately with twisted pair portions 2. The parallel portion 1 comprises a plurality of insulated core wires 6 aligned parallel to each other and fused to each other. The twisted pair portion 2 comprises twisted pairs each composed of two separately insulated core wires 6 twisted together. One pressure-sensitive adhesive tape or thermally fusible tape 3*b* is laminated onto one side of the cable over the whole length in the longitudinal direction of the cable, and one pressure-sensitive adhesive tape or thermally fusible tape 3 is laminated onto the other side of the twisted pair portion 2.

According to the flat cable having twisted pair portions laminated by tapes, the upper and lower portions of each of the twisted pair portions are respectively fixed onto two pressure-sensitive adhesive tapes or thermally fusible tapes. Therefore, there is a fear that, when the twisted pair portion is bent, the insulated core wire at the twisted pair end (including the side portion of the cable) is separated and is projected. Further, strictly speaking, the projection of the twisted pair portion poses a problem that the electrical characteristics of the projected twisted pair portion would be deteriorated. In addition, in the conventional flat cable having the laminated twisted pair portions, pressure-sensitive adhesive plastic tapes or thermally fusible plastic tapes are used for the lamination. This poses a problem that the interior of electronic equipment is adversely affected by noise caused by peripheral devices and, in some cases, satisfactorily stable transmission characteristics cannot be provided.

SUMMARY OF THE INVENTION

Accordingly, it is an object of the invention to provide a flat cable which, when bent, can prevent the separation or projection of twisted pair at the twisted pair end and thus can maintain the appearance of the whole cable.

It is another object of the invention to provide a flat cable which does not have any adverse effect on the transmission characteristics of the twisted pair portions.

It is a further object of the invention to reduce the adverse effect of noise caused by peripheral devices on the interior of electronic equipment.

According to the first feature of the invention, a flat cable comprises parallel portions respectively provided alternately with twisted pair portions in the longitudinal direction of the flat cable, said parallel portion comprising a plurality of insulated core wires aligned parallel to each other and fused to each other, said twisted pair portion comprising twisted pairs each composed of two separately insulated core wires twisted together, said twisted pair portion in its surface, backside, and left and right side faces being surrounded by at least one tape.

According to the second feature of the invention, a flat cable comprises parallel portions respectively provided alternately with twisted pair portions in the longitudinal direction of the flat cable, said parallel portion comprising a plurality of insulated core wires aligned parallel to each other and fused to each other, said twisted pair portion comprising twisted pairs each composed of two separately insulated core wires twisted together, a pressure-sensitive adhesive tape being laminated onto one side of the cable over the whole length of the cable in the longitudinal direction, said twisted pair portion in its surface, backside, and left and right side faces being surrounded by at least one tape.

In the flat cables according to the first and second features of the invention, the tape may be any one of a pressure-sensitive adhesive tape, a thermally fusible tape, a pressure-sensitive adhesive shield tape, and a thermally fusible shield tape.

According to the above construction, even when the flat cable is bent, the separation or projection of twisted pair at the twisted pair end can be prevented and, thus, the appearance of the whole cable can be maintained. Further, by virtue of the prevention of the separation or projection of the twisted pair, stable transmission characteristics can be maintained at the twisted pair portions. Further, when the pressure-sensitive adhesive shield tape is used, the adverse effect of noise caused by peripheral devices on the interior of electronic equipment can be reduced.

BRIEF DESCRIPTION OF THE DRAWINGS

The invention will be explained in more detail in conjunction with the appended drawings, wherein.

DESCRIPTION OF THE PREFERRED EMBODIMENTS

Preferred embodiments of the invention will be explained in conjunction with the accompanying drawings.

Figure 1:
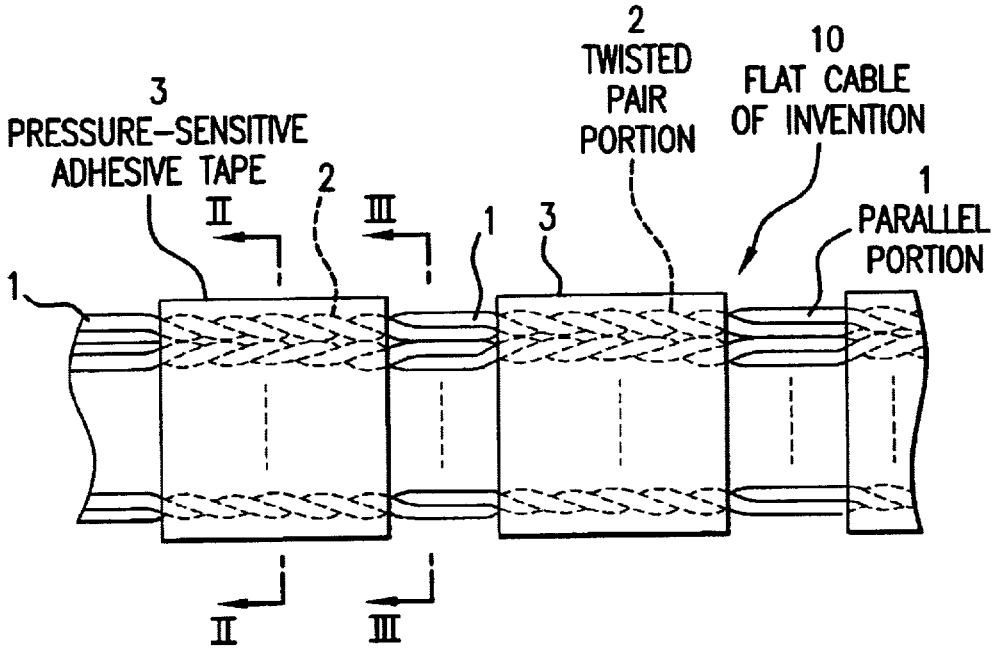
FIG. 1 is a plan view showing a first preferred embodiment of the flat cable according to the invention.
Figure 2:
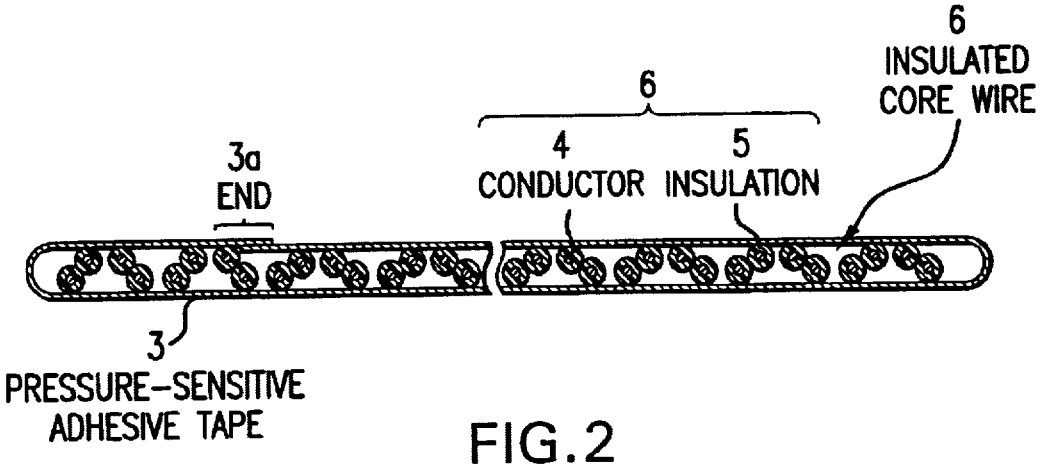
FIG. 2 is an enlarged cross-sectional view taken on line II—II of FIG. 1.
Figure 3:
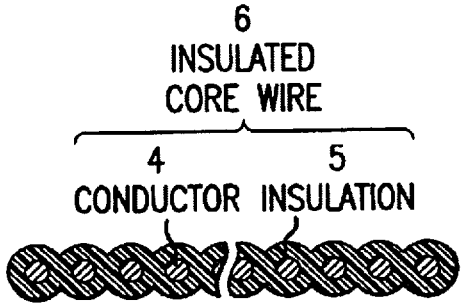
FIG. 3 is an enlarged cross-sectional view taken on line III—III of FIG. 1.

FIGS. 1 to 3 show a first preferred embodiment of the flat cable according to the invention, wherein FIG. 1 is a plan view, FIG. 2 an enlarged cross-sectional view taken on line II—II of FIG. 1, i.e., an enlarged cross-sectional view of a twisted pair portion, and FIG. 3 an enlarged cross-sectional view taken on line III—III of FIG. 1, i.e., an enlarged cross-sectional view of a parallel portion.

A flat cable 10 according to this preferred embodiment of the invention comprises parallel portions 1 respectively provided alternately with twisted pair portions 2 in the longitudinal direction of the flat cable. The parallel portion 1 comprises a plurality of insulated core wires 6 aligned parallel to each other in the longitudinal direction and fused and bonded to each other. The twisted pair portion 2 comprises twisted pairs each composed of two separately insulated core wires 6 twisted together. In the twisted pair portion 2, the twisted pair portion 2 is wound with a pressure-sensitive adhesive tape 3 from the widthwise direction of the flat cable 10, the surface, backside, and left and right side faces are surrounded by one tape, and ends 3*a* of the pressure-sensitive adhesive tape 3 are slightly overlapped with each other on the surface side (or backside) of the twisted pair portion to laminate the tape onto the whole twisted pair portion 2. A thermally fusible tape, a pressure-sensitive adhesive shield tape, or a thermally fusible shield tape may be used instead of the pressure-sensitive adhesive tape 3.

Here the insulated core wire 6 comprises a conductor 4 and an insulation 5 covering the circumference of the conductor 4. The conductor 4 may be, for example, an annealed copper wire. The conductor 4, however, is not limited to the annealed copper wire. The insulation 5 is formed of, for example, a heat resistant polyolefin thermoplastic elastomer (heat resistant TPO) or polyvinyl chloride (PVC). The material for the insulation 5, however, is not limited to these materials only.

The pressure-sensitive adhesive tape or thermally fusible tape comprises a pressure-sensitive adhesive coated on one side of the plastic tape. An example of the plastic tape is a polyethylene terephthalate (PET) tape. The material for the plastic tape, however, is not particularly limited to this material only. The pressure-sensitive adhesive may be, for example, a polyester coating composition. The pressure-sensitive adhesive, however, is not limited to the polyester coating composition.

The pressure-sensitive adhesive shield tape or the thermally fusible shield tape comprises a pressure-sensitive adhesive coated on one side of the shield material. Examples of shield materials include, but are not limited to, aluminum and copper. The pressure-sensitive adhesive in the shield material may be, for example, a polyester coating composition. The pressure-sensitive adhesive, however, is not limited to the polyester coating composition.

By virtue of the above construction, even when the twisted pair portion 2 is bent, there is no fear that the insulated core wires 6 in the twisted pair end are separated and projected. Thus, the appearance of the cable can be maintained. Further, since the twisted pair portion is not projected, the electrical characteristics of the twisted pair portion are not deteriorated. When the pressure-sensitive adhesive shield tape is used instead of the pressure-sensitive adhesive tape 3, the adverse effect of noise caused by peripheral devices on the interior of electronic equipment can be reduced.

Figure 4:
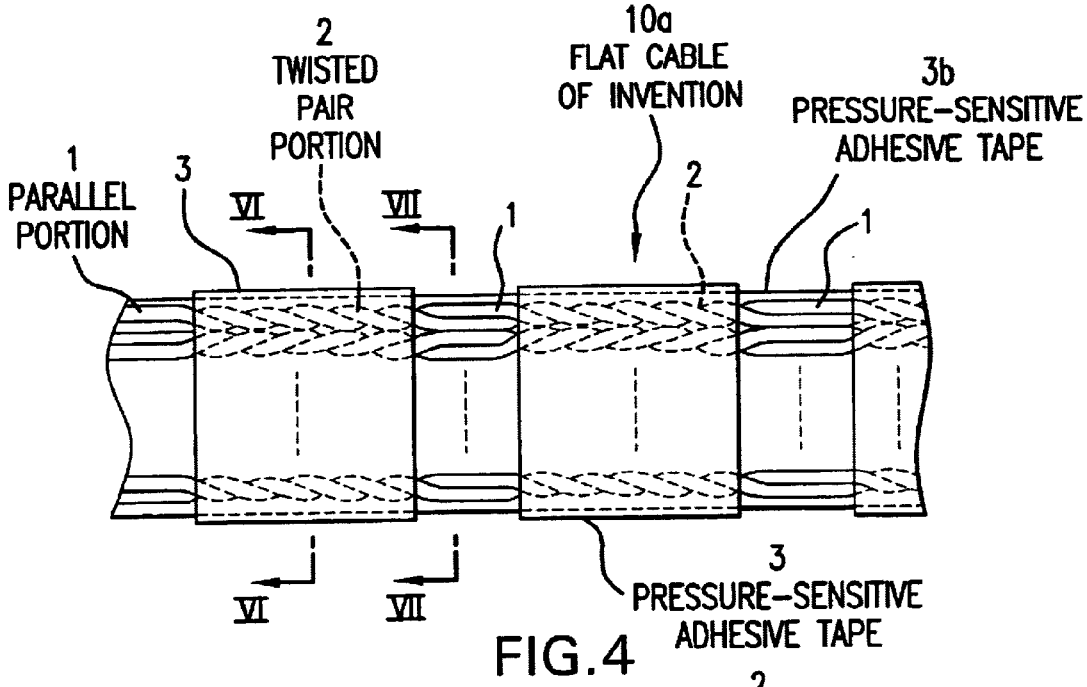
FIG. 4 is a plan view (a surface view) showing a second preferred embodiment of the flat cable according to the invention.
Figure 5:
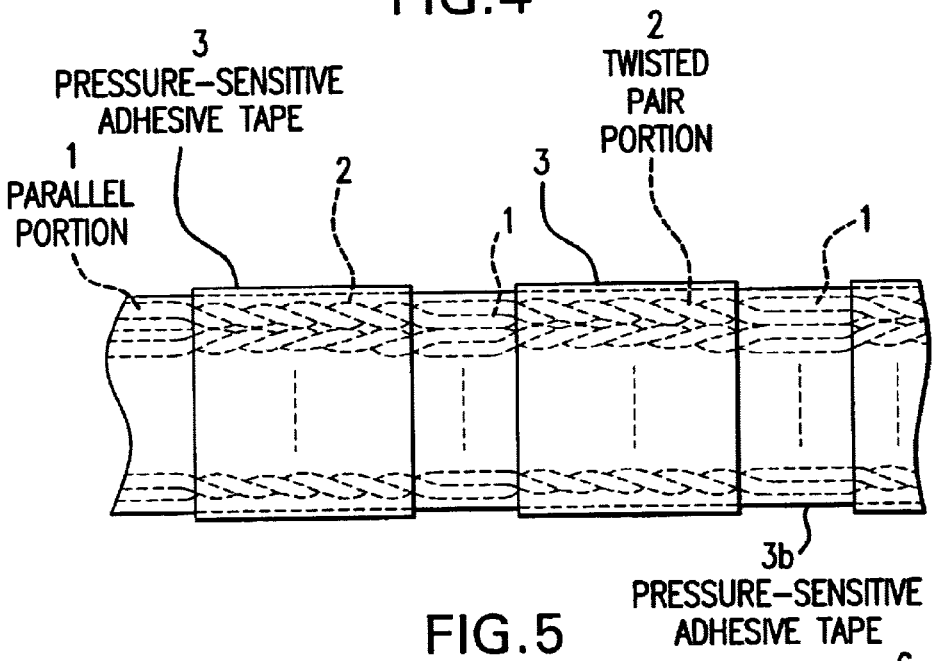
FIG. 5 is a bottom view (a backside view) showing the second preferred embodiment of the flat cable according to the invention.
Figure 6:
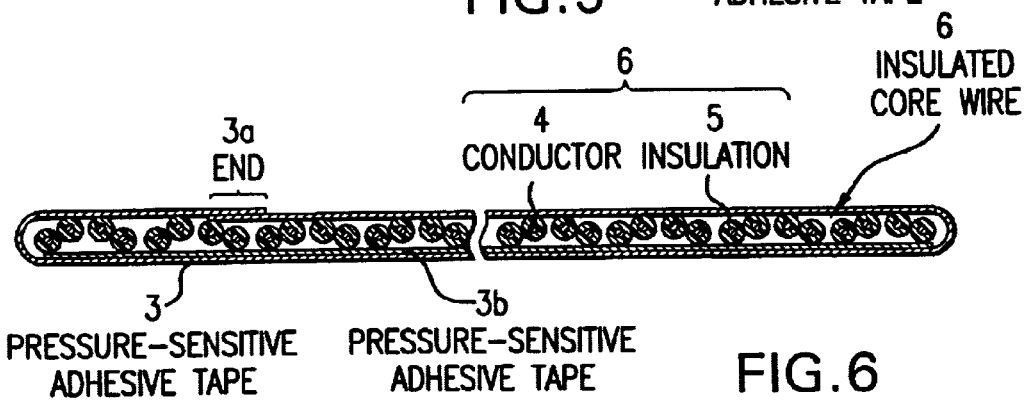
FIG. 6 is an enlarged cross-sectional view taken on line VI—VI of FIG. 4.
Figure 7:
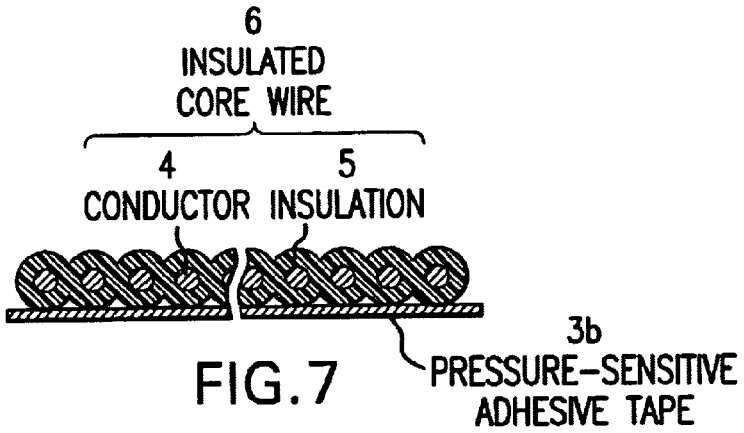
FIG. 7 is an enlarged cross-sectional view taken on line VII—VII of FIG. 4.
Figure 8:
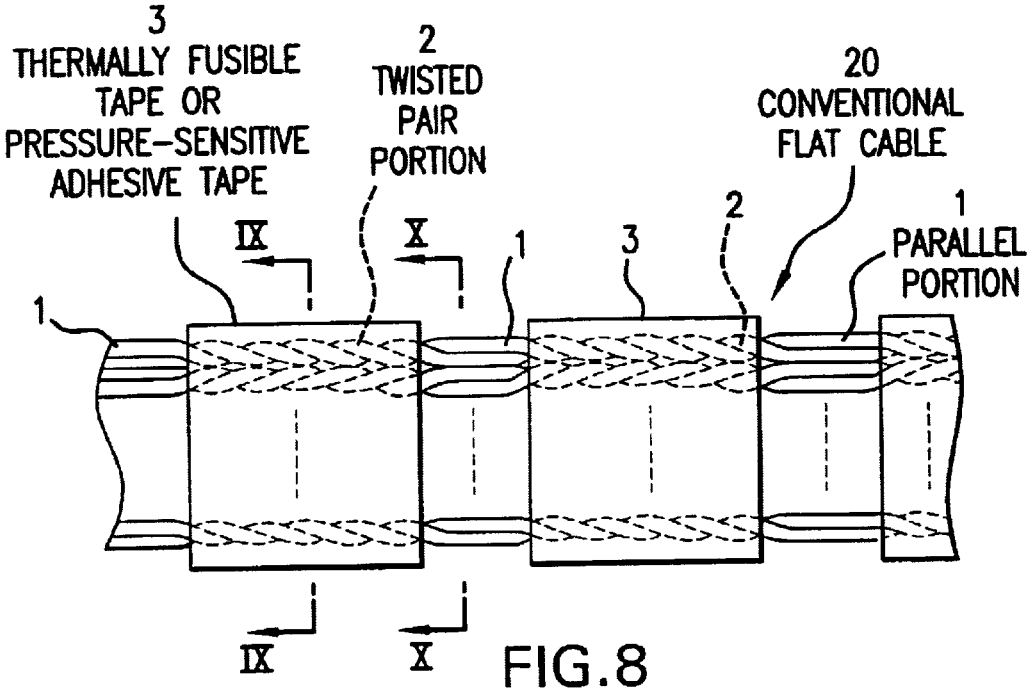
FIG.8 PRIOR ART
FIG. 8 is a plan view of a conventional flat cable.
Figure 9:
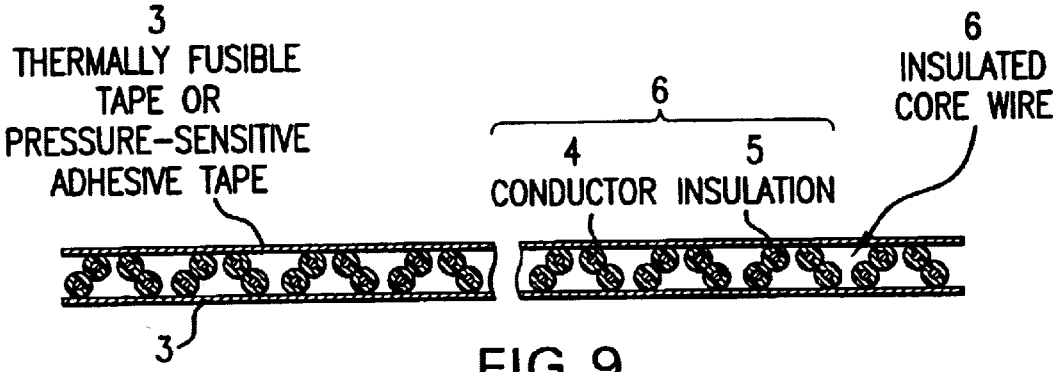
FIG.9 PRIOR ART
FIG. 9 is an enlarged cross-sectional view taken on line IX—IX of FIG. 8.
Figure 10:
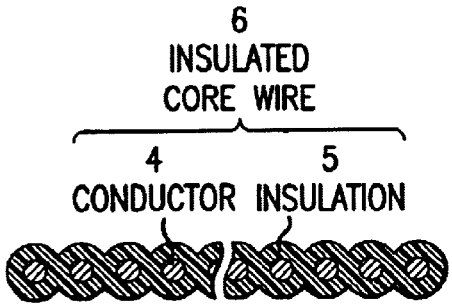
FIG.10 PRIOR ART
FIG. 10 is an enlarged cross-sectional view taken on line X—X of FIG. 8.
Figure 11:
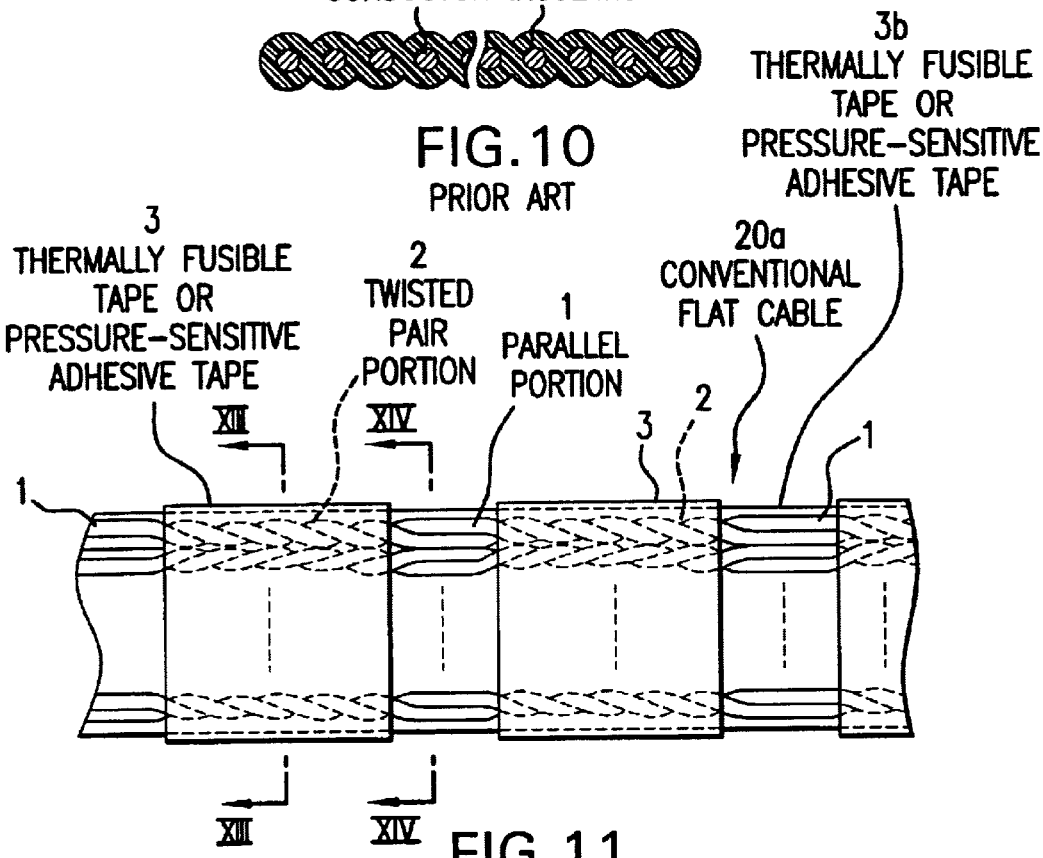
FIG.11 PRIOR ART
FIG. 11 is a plan view (a surface view) of another example of the conventional flat cable.
Figure 12:
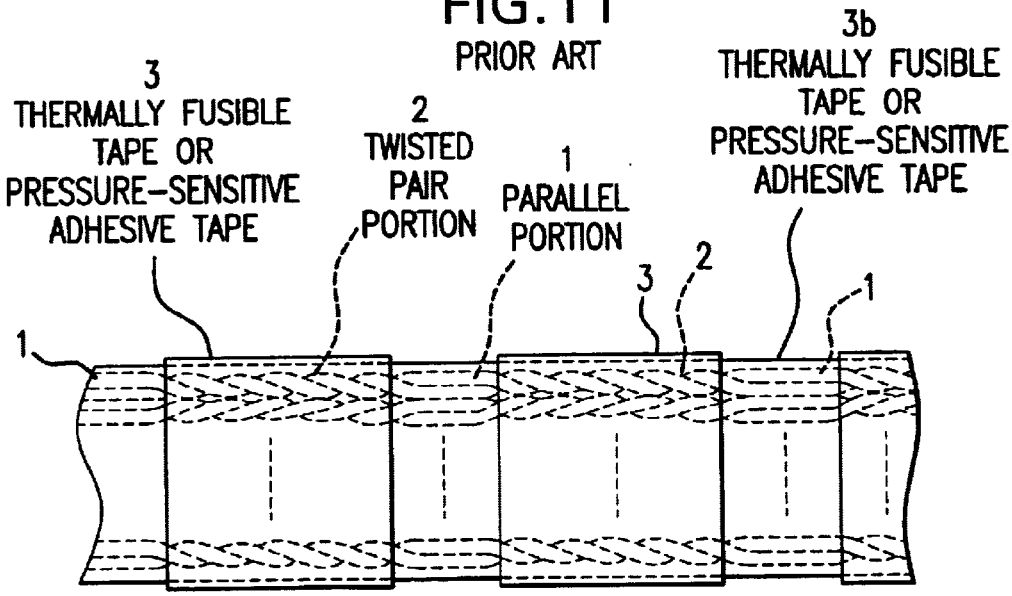
FIG.12 PRIOR ART
FIG. 12 is a bottom view (a backside view) of the another example of the conventional flat cable.
Figure 13:
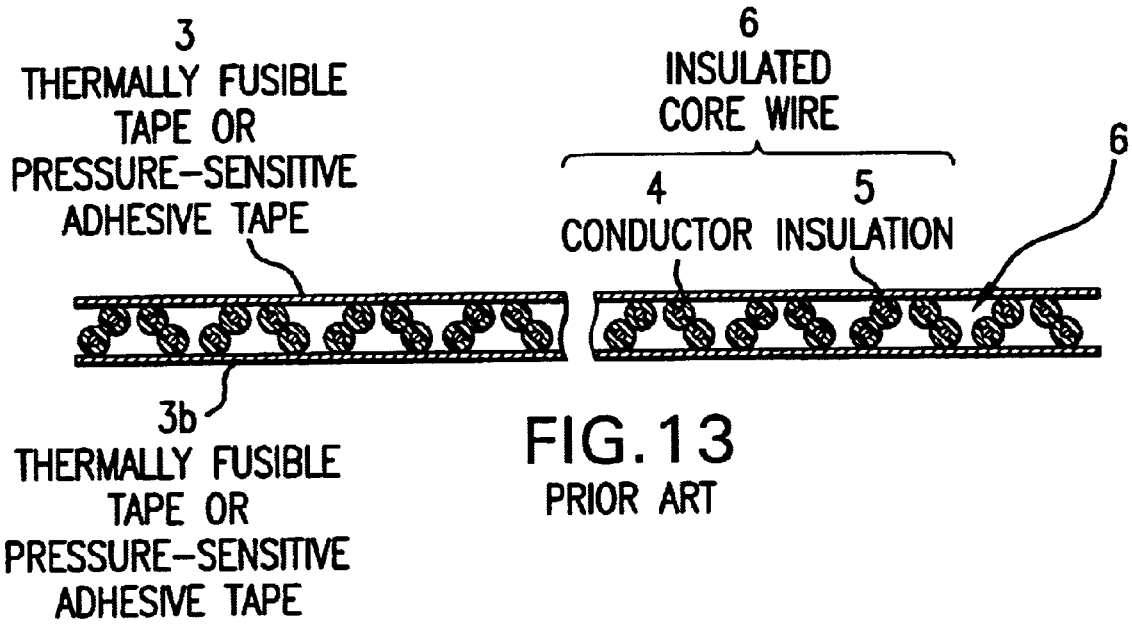
FIG. 13 PRIOR ART
FIG. 13 is an enlarged cross-sectional view taken on line XIII—XIII of FIG. 11.
Figure 14:
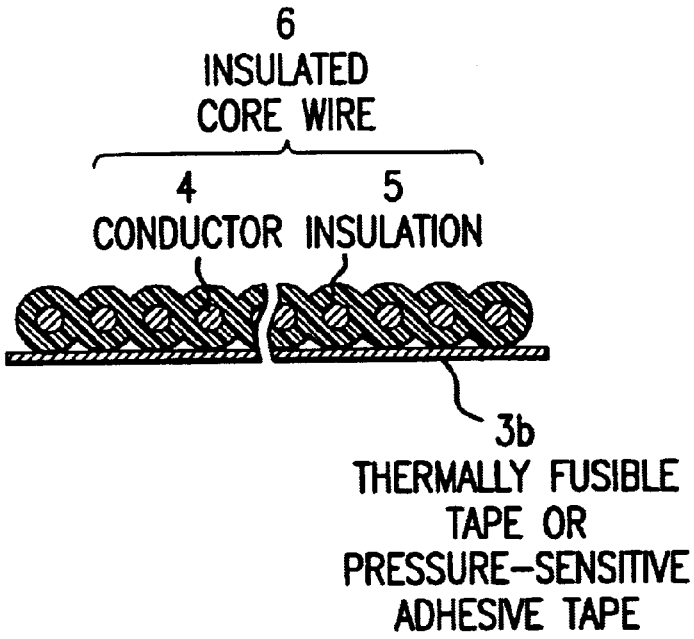
FIG. 14 PRIOR ART
FIG. 14 is an enlarged cross-sectional view taken on line XIV—XIV of FIG. 11.

FIGS. 4 to 7 show a second preferred embodiment of the flat cable according to the invention, wherein FIG. 4 is a plan view (a surface view), FIG. 5 a bottom view (a backside view), FIG. 6 an enlarged cross-sectional view taken on line VI—VI of FIG. 4, i.e., an enlarged cross-sectional view of a twisted pair portion, and FIG. 7 an enlarged cross-sectional view taken on line VII—VII of FIG. 4, i.e., an enlarged cross-sectional view of a parallel portion.

A flat cable 10*a* according to this preferred embodiment of the invention comprises parallel portions 1 respectively provided alternately with twisted pair portions 2 in the longitudinal direction of the flat cable. The parallel portion 1 comprises a plurality of insulated core wires 6 aligned parallel to each other in the longitudinal direction and fused and bonded to each other. The twisted pair portion 2 comprises twisted pairs each composed of two separately insulated core wires 6 twisted together. A pressure-sensitive adhesive tape 3*b* is laminated onto one side (bottom side (backside) in FIG. 6) of the twisted pair portion 2 over the whole length in the longitudinal direction of the cable. Further, the twisted pair portion 2 is wound with a pressure-sensitive adhesive tape 3 together with the pressure-sensitive adhesive tape 3*b* from the widthwise direction of the flat cable 10*a*, the surface, backside, and left and right side faces are surrounded by one tape, and ends 3*a* of the pressure-sensitive adhesive tape 3 are slightly overlapped with each other on the surface side (or backside) of the twisted pair portion 2 to laminate the tape onto the whole twisted pair portion 2. A thermally fusible tape, a pressure-sensitive adhesive shield tape, or a thermally fusible shield tape may be used instead of the pressure-sensitive adhesive tape 3.

In this preferred embodiment, the conductor 4, the insulation 5, the pressure-sensitive adhesive tape 3 and the like are the same as those in the first preferred embodiment.

Also in this preferred embodiment, even when the twisted pair portion 2 is bent, there is no fear that the insulated core wires 6 in the twisted pair end are separated and projected. Thus, the appearance of the whole cable can be maintained. Further, since the twisted pair portion is not projected, the electrical characteristics of the twisted pair portion are stable.

Further, when the pressure-sensitive adhesive shield tape is used instead of the pressure-sensitive adhesive tape 3, the adverse effect of noise caused by peripheral devices on the interior of electronic equipment can be reduced.

As is apparent from the foregoing description, according to the invention, at least one tape (at least one of a pressure-sensitive adhesive tape, a thermally fusible tape, a pressure-sensitive adhesive shield tape, and a thermally fusible shield tape) is laminated to the twisted pair portions of a flat cable so as to wrap therein the surface, backside and left and right side faces. By virtue of this construction, even when the twisted pair portion 2 is bent, there is no fear that the twisted pair in the twisted pair end is separated and projected. Thus, the appearance of the whole cable can be maintained. Further, the transmission characteristics of the twisted pair portion can be stably maintained. Further, when a pressure-sensitive adhesive shield tape or a thermally fusible shield tape is used, the adverse effect of noise caused by peripheral devices on the interior of electronic equipment can be reduced.

The invention has been described in detail with particular reference to preferred embodiments, but it will be understood that variations and modifications can be effected within the scope of the invention as set forth in the appended claims.

What is claimed is:

1. A flat cable comprising parallel portions respectively provided alternately with twisted pair portions in the longitudinal direction of the flat cable, said parallel portions comprising a plurality of insulated core wires aligned parallel to each other and fused to each other, said twisted pair portions comprising twisted pairs each comprising two separately insulated core wires twisted together, wherein a plurality of said twisted pair portions in its surface, backside, and left and right side faces being wound and surrounded by at least one tape, and wherein a plurality of said parallel portions are not surrounded by said at least one tape.

2. A flat cable comprising parallel portions respectively provided alternately with twisted pair portions in the longitudinal direction of the flat cable, said parallel portions comprising a plurality of insulated core wires aligned parallel to each other and fused to each other, said twisted pair portions comprising twisted pairs each composed of two separately insulated core wires twisted together, a pressure-sensitive adhesive tape being laminated onto one side of the cable over the whole length of the cable in the longitudinal direction, wherein a plurality of said twisted pair portions in its surface, backside, and left and right side faces being wound and surrounded by at least one tape, and wherein plurality of said parallel portions are not surrounded by said at least one tape.

3.The flat cable according to claim 1, wherein said at least one tape is any of a pressure-sensitive adhesive tape, a thermally fusible tape, a pressure-sensitive adhesive shield tape, and a thermally fusible shield tape.

4. The flat cable according to claim 2, wherein said at least one tape is any one of a pressure-sensitive adhesive tape, a thermally fusible tape, a pressure-sensitive adhesive shield tape, and a thermally fusible shield tape.

* * * * *